United States Patent [19]

Nakagawa et al.

[11] 4,332,138

[45] Jun. 1, 1982

[54] REFRIGERATING APPARATUS

[75] Inventors: Noboru Nakagawa, Osaka; Toshiyuki Oonishi, Takatsuki; Masato Tsutsumi, Osaka; Akira Kawamoto, Takatsuki, all of Japan

[73] Assignee: Tokyo Shibaura Denki Kabushiki Kaisha, Japan

[21] Appl. No.: 154,464

[22] Filed: May 29, 1980

[30] Foreign Application Priority Data

Aug. 8, 1979 [JP] Japan ..... 54-101087
Aug. 8, 1979 [JP] Japan ..... 54-101088

[51] Int. Cl.[3] ..... F25B 5/00

[52] U.S. Cl. ..... 62/199; 62/504; 62/525

[58] Field of Search ..... 62/199, 200, 504, 525

[56] References Cited

U.S. PATENT DOCUMENTS 2,514,792 7/1950 Philipp ..... 62/504
2,697,331 12/1954 Zearfoss, Jr. ..... 62/199
2,791,101 5/1957 Zearfoss, Jr. ..... 62/199
4,130,997 12/1978 Hara et al. ..... 62/199

*Primary Examiner*—Ronald C. Capossela
*Attorney, Agent, or Firm*—Finnegan, Henderson, Farabow, Garrett & Dunner

[57] ABSTRACT

Refrigerating apparatus comprising freezing and refrigerating compartments, to be controlled to different temperatures, which are provided with respective evaporators. During operation of a compressor, liquid refrigerant is always fed to the freezer evaporator, but is selectively fed to the refrigerator evaporator by function of a feed control device which comprises a vapor bubble pump as its essential component. The feed control device is supported by an insulation board which, in turn, is mounted on the back surface of an inner shell forming the freezing compartment such that a ratio of a distance 1 between the outer surface of the inner shell of the freezing compartment and the innermost surface of the feed control device with respect to the thickness m of the insulation wall filling the heat-insulation space defined by the inner shell and an outer shell of the freezing compartment.

8 Claims, 13 Drawing Figures

REFRIGERATING APPARATUS

BACKGROUND OF THE INVENTION

This invention relates to a refrigerating apparatus, more particularly to an improvement in a refrigerating apparatus in which at least two evaporators are controlled to different temperatures.

Generally, a refrigerator having a freezing compartment and refrigerating compartment, which are controlled to different temperatures, has separate evaporators for the freezing compartment and for the refrigerating compartment because separate cooling is necessary for each compartment. Although the separate evaporators are provided, it is preferable that a compressor and a condenser are used in common to those separate evaporators. Accordingly, refrigerant feed control to one or both of the evaporators is necessary. For example, the refrigerant is always fed to the freezing evaporator while the refrigerant is selectively fed to the refrigerating evaporator by the function of a solenoid valve when the compressor is energized. Thus, separate temperature control is attained by a control of the solenoid valve in conjunction with a control to the compressor.

However, such a solenoid valve has a mechanically movable valve which is buried in a heat-insulating material so that it is difficult to maintain or inspect the valve after the refrigerator is assembled. Accordingly, the life and the reliability of the refrigerator are not sufficient, and, moreover, this structure is too expensive.

Feed control devices or arrangements which employ a vapor bubble pump providing valve action to the refrigerant have been developed. Thus, mechanical movable parts can be eliminated from the feed control devices of the refrigerator. Such arrangements are disclosed, for example, in the U.S. Pat. No. 2,697,331.

However, the operation of the vapor bubble pumps tends to suffer from the ambient temperature of the vapor bubble pumps. Further, several parts forming the feed control arrangement are required to be disposed in a predetermined position when such parts are installed in the refrigerator.

SUMMARY OF THE INVENTION

Accordingly, one object of this invention is to provide a refrigerating apparatus which has a refrigerant feed control arrangement incorporating a vapor bubble pumps of stable operation.

Another object of the invention is to provide a refrigerating apparatus having a refrigerant feed control arrangement incorporating a vapor bubble pump of stable operation, which is easy to assemble.

According to one aspect of the present invention, a refrigerating apparatus comprises: a compressor; a plurality of compartments to be controlled to different temperatures, each compartment being thermally insulated from ambient temperature by insulation wall members and being provided with a refrigerant evaporator; and feed control means, including a vapor bubble pump positioned within one of the insulation wall members, for controlling refrigerant flow caused by the compressor to at least one of the evaporators.

BRIEF DESCRIPTION OF THE DRAWINGS

FIG. 2 shows the vapor bubble pump not in operation and FIG. 3 shows the vapor bubble pump in operation.

DETAILED DESCRIPTION OF THE PREFERRED EMBODIMENT

Figure 1:
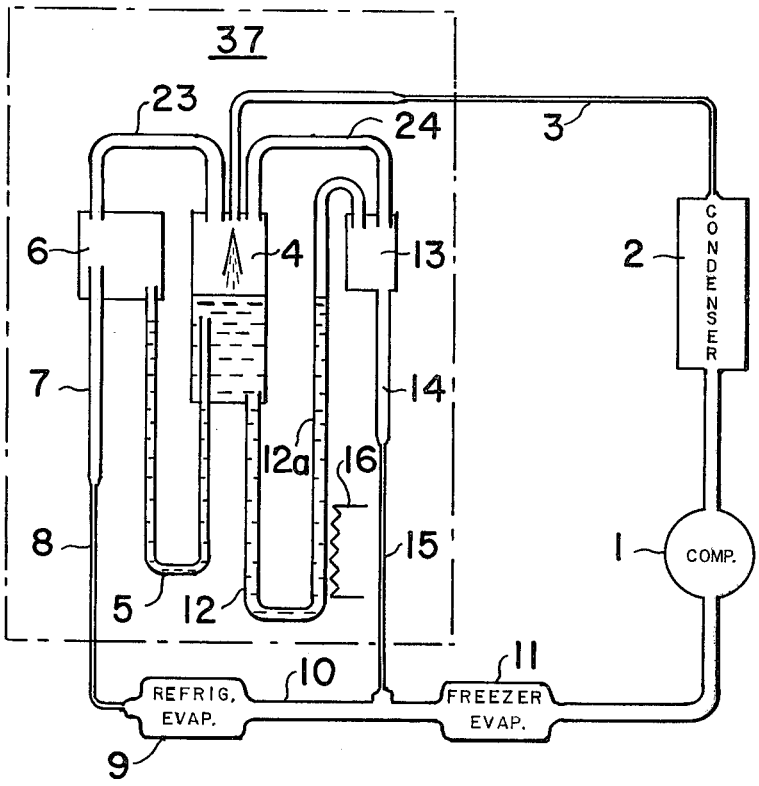
FIG. 1 shows a schematic view of a refrigerant flow circuit of this invention.

Referring to FIG. 1, high temperature gas of a refrigerant, which is compressed by a compressor 1, is condensed by a condenser 2 and supplied to a liquid tank 4 through a pressure regulator such as a capillary tube 3. One end of a U-shaped conduit 5 is located in tank 4 and extends through the bottom of tank 4. The other end of conduit 5 is connected to a bottom opening of an accumulator or reservoir 6. One end of a conduit 7 is located in accumulator 6 and extends through the bottom thereof. Conduit 7 is connected to a refrigerator evaporator 9 through a pressure regulator such as a capillary tube 8. Refrigerator evaporator 9 is connected to a freezer evaporator 11 by a connecting conduit 10 and freezer evaporator 11 is connected to compressor 1 to form a closed refrigerating cycle.

One end of another U-shaped conduit 12, with a diameter larger than that of conduit 5, is connected to a bottom opening of tank 4 and the other end of conduit 12 is connected to an opening in the top of a joint chamber 13 by bending downwardly. A rising portion 12*a* of conduit, connected to the chamber 13, 12 extends higher than the top of conduit 7 which is connected to accumulator 6. One end of a conduit 14 is connected to an opening in the lower portion of joint chamber 13 and the other end of conduit 14 is connected to connecting conduit 10 through a pressure regulator such as a capillary tube 15 with a resistivity larger than that of capillary tube 8.

Figure 4:
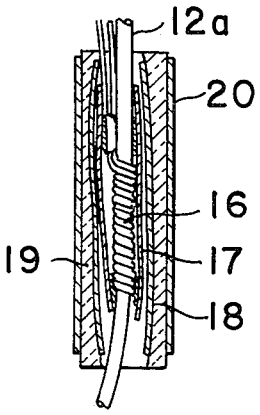
FIG. 4 shows a schematic, enlarged, cross-sectional view of the vapor bubble pump heater arrangement shown in FIGS. 1, 2, and 3.

A heater 16 is provided at the lower part of rising portion 12*a*. As shown in FIG. 4 in more detail, heater 16, wound around rising portion 12*a*, is fixed in position by a heat-resistant tape 17 and then is wound by an aluminum foil tape 18. Further, there is provided a thermal insulation layer 19 of glass wool or the like between the aluminum foil layer and a protective sheath 20.

Figure 5:
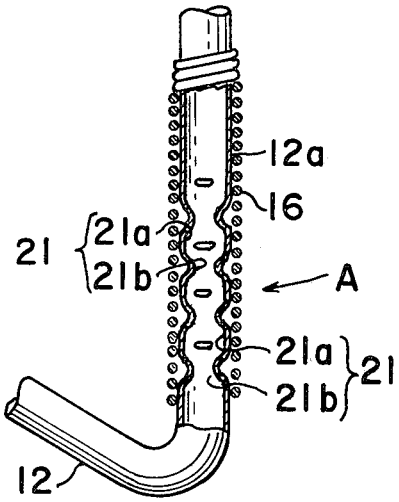
FIG. 5 is an enlarged view, partly in section, of the vapor bubble pump shown in FIGS. 1, 2, and 3.

As shown in FIG. 5, conduit 12 has an irregularly formed portion 21 with alternate concave surfaces 21*a* and convex surfaces 21*b* at the lower end of its part surrounded by heater 16. Rising portion 12*a*, concave portion 21*a*, convex portion 21*b* and heater 16 form a vapor bubble pump A.

Figure 6:
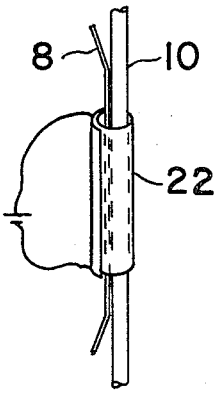
FIG. 6 shows a schematic perspective view of a connecting conduit heater for use in the circuit shown in FIG. 1.
Figure 13:
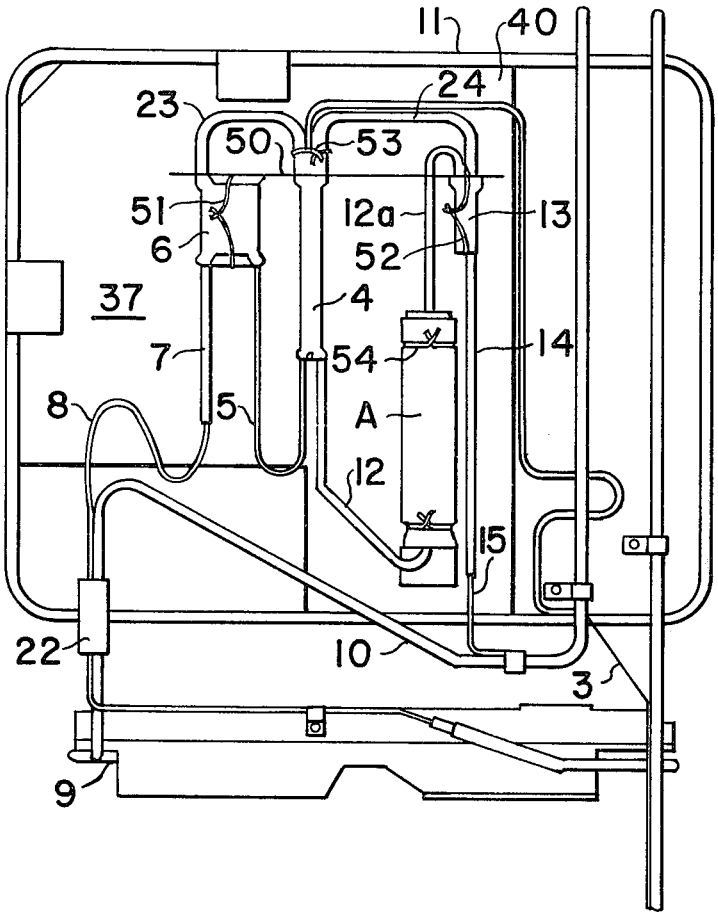
FIG. 13 is a schematic plan view of the assembled feed control device of the invention.

As shown in FIGS. 6 and 13, a portion of capillary tube 8 is juxtaposed with a portion of connecting conduit 10 which is near refrigerator evaporator 9, and a heater 22, such as an aluminum foil heater, is wound around at least part of juxtaposed portions. Heater 22 functions to prevent transfer of coldness from freezer evaporator 11 to refrigerator evaporator 9 along connecting conduit 10 and also to increase the capillary effect of capillary tube 8 when heater 22 is energized.

Referring again to FIG. 1, the inner pressures of tank 4, accumulator 6 and joint chamber 13 are equalized by conduits 23 and 24, having a larger diameter than that of conduit 5, which are connected between tank 4 and accumulator 6 and between tank 4 and joint chamber 13, respectively.

Thus, feed control arrangement, generally indicated at 37, is formed substantially by tank 4, accumulator 6, conduits 5, 7, and 23, joint chamber 13, conduits 12, 14 and 24, and heater 16.

Figure 7:
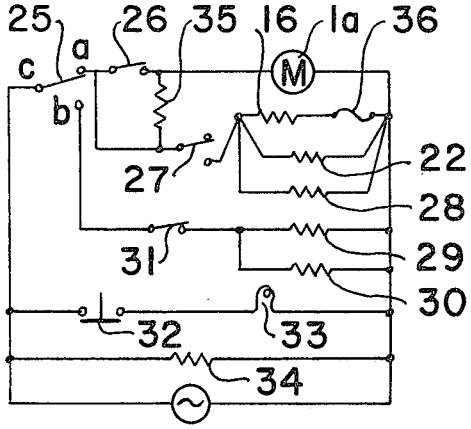
FIG. 7 shows a wiring diagram for the apparatus of the invention.

FIG. 7 is a wiring diagram of this embodiment. Generally, compressor 1 operates within a given temperature range of the freezing compartment except when defrosting operation is selected. During the operation of compressor 1 which depends on the temperature of the freezing compartment, refrigerant is always fed to freezer evaporator 11, but refrigerant flow caused by compressor 1 is selectively fed to freezer evaporator 9 depending on the temperature of the freezing compartment for preventing the same from being over-cooled.

A motor 1*a* of compressor 1 is driven when the contacts (a–c) of a defrost switch 25 are closed (i.e., defrosting operation is not chosen) upon the closure of a control switch 26, which is closed when the temperature of the freezing compartment reaches a given value. Heater 16 of vapor bubble pump A, connecting conduit heater 22, and a drain gutter heater 28 are energized when the temperature of the refrigerating compartment falls below a predetermined value so that a refrigerating control switch 27 is turned on. Drain gutter heater 28 functions to prevent freezing of water in the drain gutter for disposing of defrosted water.

Feed of refrigerant to refrigerator evaporator 9 is stopped for preventing the refrigerating compartment from being over-cooled due to energization of heater 16 as hereinafter set forth. The motor 1*a* of compressor 1 is stopped when the freezing compartment is cooled to a predetermined temperature so that control switch 26 is turned off.

The defrosting cycle, which is conventional, is attained by closing contacts (b–c) of defrost switch 25 to energize a defrost heater 29 for heating freezer evaporator 11 and a defrost sensor heater 30 for obtaining stable operation of the defrost sensor. The defrost sensor comprises a bimetal switch 31 which opens when the defrosting cycle is finished.

A door switch 32 is closed when the door of the refrigerating compartment is opened and a lamp 33 which is located in the refrigerating compartment is turned on. A drain pipe heater 34 prevents a drain opening of the freezing compartment from freezing, a heater 35 heats control switch 26 for stable operation thereof, and a fuse 36 is connected in series with heater 16 of vapor bubble pump A.

Figure 2:
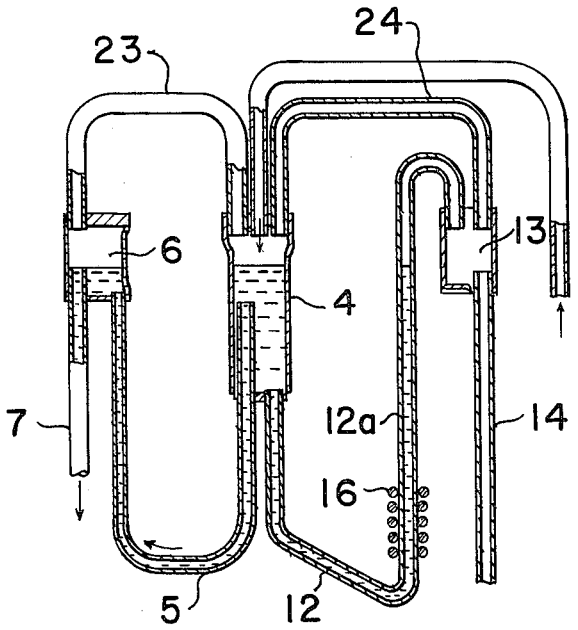
FIGS. 2 and 3 are schematic cross-sectional views, partly in elevational view, of the feed control device incorporated in the circuit shown in FIG. 1.
Figure 3:
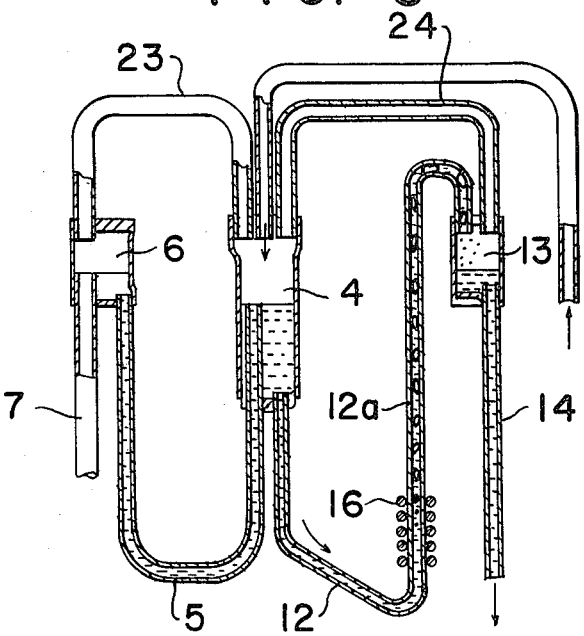

The operation will now be explained. When the temperatures of the refrigerating compartment and the freezing compartment are higher than respective predetermined values, control switch 26 is kept closed and refrigerating control switch 27 is kept open. Then motor 1*a* of compressor 1 is driven while heater 16 is kept de-energized. The refrigerant which is compressed by compressor 1 and condensed by condenser 2 is stored in liquid tank 4. The liquid refrigerant flows into accumulator 6 through U-shaped conduit 5 when the liquid level in tank 4 rises higher than the top of U-shaped conduit 5 in tank 4, as easily understood from FIG. 2.

The liquid refrigerant goes to refrigerator evaporator 9 and the freezer evaporator 11 through conduit 7 and capillary tube 8 so that the refrigerating compartment and the freezing compartment are cooled.

In this condition, it is expected that the liquid refrigerant will not flow into conduit 14 through U-shaped conduit 12 and joint chamber 13 because rising portion 12*a* extends higher than the top of conduit 7 in accumulator 6, the inner pressures of tank 4, accumulator 6 and joint chamber 13 are kept equal by conduits 23 an 24, as the liquid level in tank 4, accumulator 6 and U-shaped condiut 12 are kept equal, and also because capillary tube 15 between conduits 14 and 10 has fluid resistivity larger than capillary tube 8.

However, if joint chamber 13 should be positioned at a lower location than accumulator 6, for example, when they are installed in the refrigerator, such that the uppermost inverted U-shaped bent part of rising portion 12*a* is approximately the same level as the liquid in tank 4, then the liquid refrigerant would flow into conduit 14 with the result that an amount of refrigerant would not flow into refrigerator evaporator 9. Thus, positioning of parts with accuracy is required.

Heater 16 is energized when control switch 27 turns on due to the fact that the refrigerator compartment has been cooled to a predetermined temperature. Vapor bubbles of liquid refrigerant in rising portion 12*a* are produced by heating rising portion 12*a* with heater 16. The liquid refrigerant is pumped up by the bubbles and overflows from the top of rising portion 12*a* into joint chamber 13, as easily understood from FIG. 13. Then, the liquid refrigerant flows into freezer evaporator 11 through conduit 14 and capillary tube 15, and cools the freezing compartment. At this time, the liquid level in tank 4 is reduced as the liquid refrigerant flows into freezing evaporator 11 through joint chamber 13. Thus it is expected that the liquid refrigerant will not flow to refrigerator evaporator 9 through accumulator 6 and conduit 7. The cooling of the refrigerating compartment is interrupted when the flow of liquid refrigerant into refrigerator evaporator 9 is stopped.

In this embodiment, it is intended that compressor 1 is driven depending on the temperature of the freezing compartment by function of control switch 26 and that during the operation of compressor 1 the freezing compartment is always cooled but the refrigerating compartment is selectively cooled depending on the temperature of the refrigerating compartment by means of alternative operation in energization or de-energization of heater 16.

It should be borne in mind that the operation of vapor bubble pump A tends to depend on the ambient temperature thereof. It is desirable, therefore, to locate vapor bubble pump A in a constant ambient temperature. However, if vapor bubble pump A is located in ambient temperature lower than the temperature of the outer surface of the vapor bubble pump A, the efficiency of the vapor bubble pump A is reduced because the vapor bubbles produced by energization of heater 16 tend to be cooled more and then to shrink more otherwise.

It is also noted that the vapor bubble pump needs a time interval after heat is applied and before beginning its pumping action due to the time required for the bubbles to increase in size, although vapor bubble pump A of this embodiment is improved as follows. Heater 16 is wound around the outer surface of the irregularly formed portion 21 and about the portion above irregularly formed portion 21, so that the bubbles are produced relatively quickly at irregularly formed portion 21. The bubbles produced at the portion above irregularly formed portion 21 are produced smoothly and the resistance against the flow of the liquid refrigerant including the bubbles is small because the inner surface of such portion is smooth. Thus the bubbles can go up smoothly and pumping action for pushing up the refrigerant begins relatively quickly. The pumping efficiency is thus improved.

There is a case where both the motor 1*a* of compressor 1 and heater 16 begin to be energized simultaneously, i.e., only the freezing compartment needs to start being cooled. Particularly, in this situation, relatively a lot of liquid refrigerant tends to flow into tank 4 upon starting of operation of compressor 1 before pumping action of vapor bubble pump A is fully built up. Accordingly, the refrigerant tends to flow into accumulator 6 from tank 4 with the result that the refrigerating compartment tends to be over-cooled. In this embodiment, such action is effectively prevented, since conduit 5 has a diameter smaller than that of conduit 12, providing a time lag for feeding the refrigerant to conduit 7. Also conduit 23 for equalizing the liquid level of accumulator 16 and tank 4 functions to prevent the liquid level in accumulator 6 from rising abnormally, and beause capillary tube 8 between conduit 7 and refrigerator evaporator 9 is heated by heater 22 which is energized together with heater 16 so that the capillary effect of capillary tube 8 increases at heated portion thereof and this, in turn, increases suppression of refrigerant flow to refrigerator evaporator 9 even if the refrigerant should flow into the conduit 7.

However, if accumulator 6 is positioned at a location lower than joint chamber 13 aligned with tank 4, for example, in installation, a bubble pump needs more pumping ability to obtain expected operation of feed control device 37 since the liquid refrigerant in tank 4 is likely to flow into refrigerating evaporator 9. Accordingly, positioning of the parts with accuracy is also required to obtain proper operation.

Thus it is necessary to determine carefully the ambient temperature of vapor bubble pump A and the positioning of the parts forming feed control arrangement 37.

Figure 8:
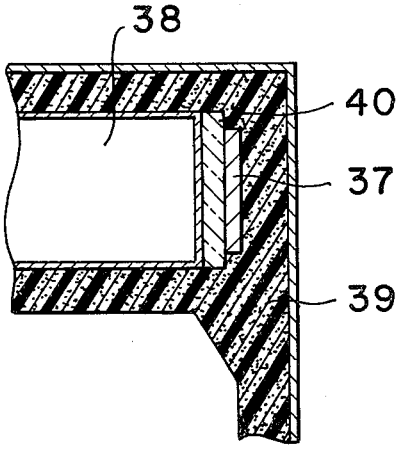
FIG. 8 is an elevationally section view for explaining the positioning of the feed control devices shown in FIGS. 1, 2, and 3 when assembled.
Figure 9:
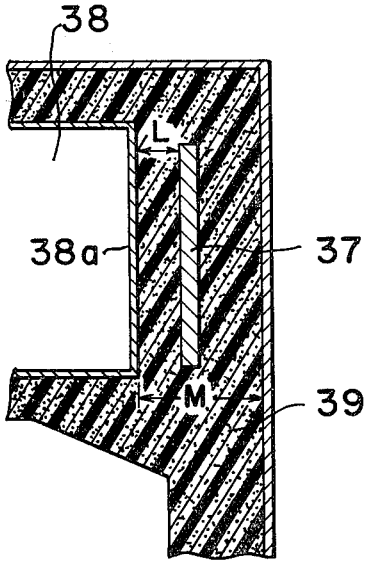
FIG. 9 is an explanatory view for determining the position of the feed control device in an insulation wall.

Referring now to FIGS. 8 and 9, feed control arrangement 37 incorporating vapor bubble pump A as an essential component is buried within the insulation foam 39 located preferably behind freezer compartment 38. A thermal insulation 40 of a predetermined thickness is mounted on an outer surface of a back plate 38*a* of an inner shell defining freezer compartment 38 and parts forming feed control arrangement 37 are mounted on insulation board 40. Then the remaining space is filled with insulation foam 39. Insulation board 40 may preferably be of rigid insulation foam.

Figure 10:
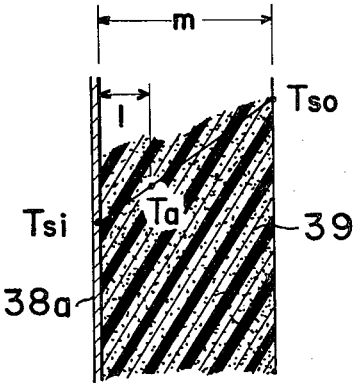
FIG. 10 is an explanatory view for showing temperature distribution in the insulation wall shown in FIG. 9.
Figure 11:
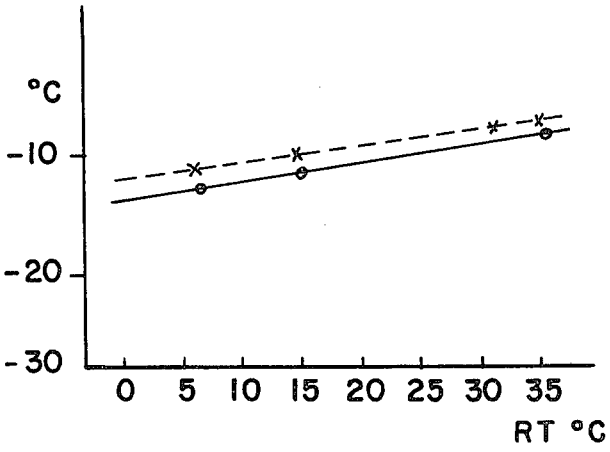
FIG. 11 is a plot for showing temperatures of insulation wall and feed control devices under a certain position when room temperature varies.

FIGS. 10 and 11 are explanatory drawings for temperature distribution within insulation foam 39 behind freezing compartment 38. As shown in FIG. 10, temperature $T_A$ at a position with distance 1 from inner shell 38*a* within insulation foam 39 will be expressed approximately by:

$$T_A = T_{si} + (T_{so} - T_{si}) \times l/m \quad (1)$$

where $T_{si}$ is the temperature of shell 38*a*, $T_{so}$ is the temperature of the outer surface of insulation foam 39, and m is thickness of insulation foam 39.

Now consider, as a general assumption, that a temperature TF of freezing compartment 38 is put 18 degrees Centigrade below zero and a room temperature RT is put 35 degrees Centigrade, then $T_{si}$ will be around −16° C. and $T_{30}$ will be around 33° C. If the thickness m of insulation foam 39 is put 75 mm, for example, the temperature $T_{A10}$ at l=10 mm will be:

$$T_{A10} = -16 + \{33 - (-16)\} \times 10/75 = -9.5 \text{ [°C.]}$$

Then the temperature $T_A$ at 1 mm position, when the room temperature RT varies while the freezing compartment TF is kept constant to be −18° C., is plotted as shown in FIG. 11 at a dotted line, wherein the temperature $T_A$ is taken along the ordinate and the room temperature along the abscissa.

According to experiments, a temperature of feed control arrangement 37, particularly of rising portion 12*a* of vapor bubble pump A is plotted as shown by a solid line in FIG. 11.

As is understood from this, the temperature within insulation foam 39 increases linearwise as the point at issue goes farther away from the freezer compartment. Hence the ambient temperature of feed control arrangement 37 can be equal to or higher than the surface temperature of vapor bubble pump A, if the distance between inner shell 38*a* and the innermost surface of feed control arrangement 37, particularly of vapor bubble pump A is equal to or more than 10 mm.

It should be noted that, according to this embodiment, feed control arrangement 37 is buried within insulating foam 39 such tha L/M is equal to or more than 10/75–0.13 where L denotes a distance between inner shell 38*a* and the innermost surface of feed control arrangement 37, and M denotes a thickness of insulation foam 39. In this embodiment, the thickness of insulation board 40 is selected to be 15 mm while the distance between inner and outer shells at that point is 75 mm, for example. In this connection, maximum thickness of feed control device 37 may be around 16 mm.

Thus relatively high pumping up efficiency can be obtained due to the fact that the temperature of vapor bubble pump A is kept lower than that of the insulation foam surrounding vapor bubble pump A.

Figure 12:
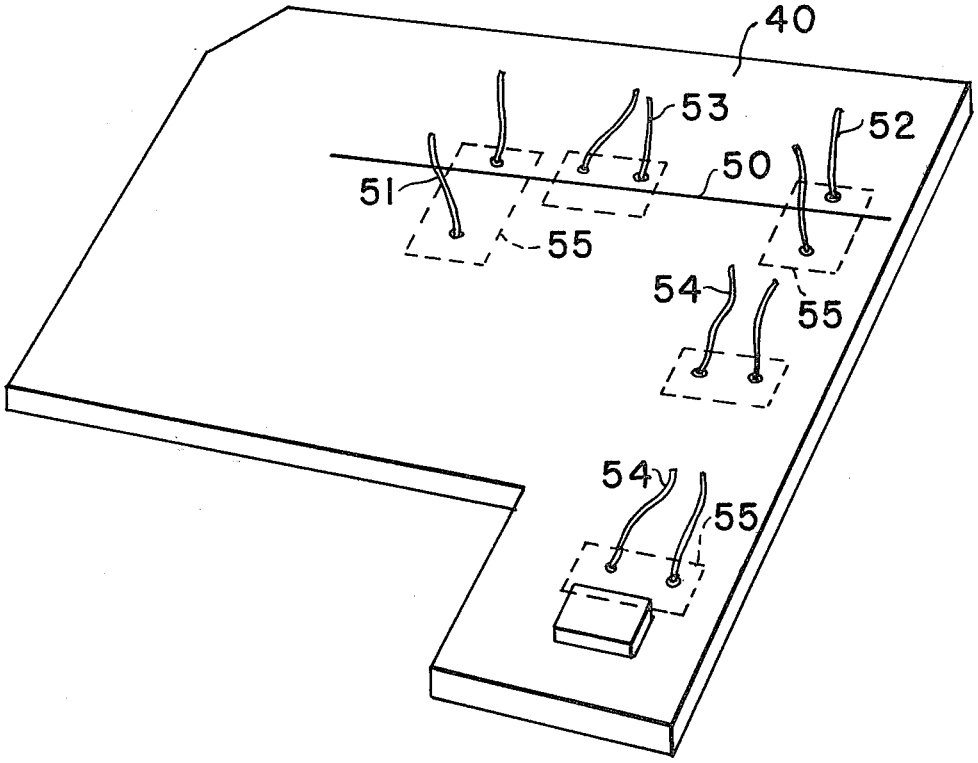
FIG. 12 is a schematic perspective view of an insulation board for carrying the feed control device of the invention.

Referring now to FIGS. 12 and 13, insulation board 40 is provided with a marking of horizontal base line 50 for reference so as to easily align top surfaces of tank 4, accumulator 6 and joint chamber 13 along the line 50. Further, insulation board 40 is provided with binding strings 51 and 52 such as, for example, wire reinforced tapes at respective positions on which accumulator 6 and joint chamber 13 are to be mounted in order that accumulator 6 and joint chamber 13 are respectively tied to insulation board 40 and are prevented from moving, particularly in the vertical direction. Insulation board 40 is also provided with binding strings 53 and 54 to bind tank 4 and vapor bubble punp A to the board. These binding strings 51, 52, 53 and 54 are mounted on board 40 such that the middle portions of the binding strings extend along the back surface of board 40 and are fixed by adhesive tapes 55, and both of the free end portions of the binding strings penetrate through board 40 to appear at the front surface of the board.

In assembling, insulation board 40 is, at first, mounted on the outer surface of back board 38*a* of freezing compartment 38 at a predetermined position. Then, accumulator 6, liquid tank 4 and connecting chamber 13 are positioned so that their upper ends align with horizontal base line marking 50, and accumulator 6 and connecting chamber 13 are fixed, respectively, in the vertical direction by strings 51 and 52 so as not to move particularly in vertical direction as shown in FIG. 13. Further, the positions of liquid tank 4 and vapor bubble pump portion A are fixed by strings 53 and 54, respectively.

Foam-forming materials supplied to insulation spaces to react in insulation form in situ, such as, for example, urethane foam, are well-known in the art.

Accordingly, horizontal base line mark 50 on insulation board 40 provides ease of aligning the top portions of tank 4, accumulator 6 and joint chamber 13, and strings 51 and 52 prevent accumulator 6 and joint chamber 13 from moving vertically. Thus feed control device 37 can be easily and reliably assembled.

It is possible to employ a relatively thin plate member for keeping the relative positions of the parts forming feed control device 37 instead of a relatively thick insulation board 40. In such case, a certain relatively narrow insulation space is left to be filled with insulation foam between inner shell 38*a* and innermost portion of such thin plate member for positioning parts forming device 37 at a predetermined location as described above. In this connection attention should be paid to avoid occurrence of void of the insulation foam upon foaming. Because such an area void in insulation foam has less heat insulation characteristics, the efficiency of vapor bubble pump is likely to be reduced more than expected due to being cooled by coldness of the freezing compartment. Employment of relatively thick insulation board 40 eliminates this possible problem and provides ease of manufacturing.

Although described above is a certain preferred embodiment, there may be many modifications or changes within the scope of the appended claims or within the spirit of this invention. For example, the feed control device may be changed to allow refrigerant flow to both refrigerator and freezer evaporators when the vapor bubble pump operates, although, according to the above embodiment, only the freezer evaporator can be fed with the refrigerant when the vapor bubble pump operates. This invention can be applied to freezing apparatus having more than two evaporators controlled to different temperatures. Although the above embodiment shows, for example, only freezer and refrigerating evaporators.

What is claimed is:

1. In refrigerating apparatus including a compressor, a plurality of compartments to be controlled to different temperatures, each compartment being thermally insulated from ambient temperature by insulation wall members and being provided with a refrigerant evaporator; and feed control means for controlling refrigerant flow caused by said compressor to at least one of said evaporators; the improvement wherein said feed control means includes a vapor bubble pump positioned within one of said insulation wall members adjacent one of said compartments, and wherein said vapor bubble pump is mounted on a surface spaced from the outer surface said adjacent compartment a distance L for maintaining the temperature of said bubble pump lower than the ambient temperature of said one of said insulation wall members.

2. The refrigerating apparatus according to claim 1 wherein a ratio of said distance L with respect to the thickness M of the insulation wall member containing said feed control means is not less than 0.13.

3. The refrigerating apparatus according to claims 1 or 2, wherein said feed control means, including said bubble pump, are mounted on a planar surface, said planar surface being spaced from said outer surface of said one compartment by the distance L.

4. The refrigerating apparatus according to claim 3, wherein said planar surface is a surface of a plate member made of heat insulation material.

5. The refrigerating apparatus according to claim 4, wherein said plate member is provided with a horizontal base line mark for aligning some of the parts forming said feed control means.

6. The refrigerating apparatus according to claim 5, wherein said plate member includes prearranged means for securing said aligned parts with respect to said horizontal base line mark for preventing vertical movement.

7. The refrigerating apparatus of claim 1 wherein said feed control means includes a tank for liquid refrigerant, a chamber for receiving the refrigerant and a conduit for transmitting the refrigerant from the tank to the chamber and said vapor bubble pump includes a portion of the wall of said conduit, the first part of said portion of the conduit wall, in the direction of flow of the refrigerant, being irregular and the following part of said portion being smooth, and said vapor bubble pump also including heater means surrounding both the irregular and smooth parts of said portion of the wall of said conduit.

8. The refrigerating apparatus of claim 7 wherein said irregular part of the portion of the conduit wall is constituted of alternating concave and convex surfaces.

* * * * *